US009506715B2

(12) United States Patent
Hughes

(10) Patent No.: US 9,506,715 B2
(45) Date of Patent: Nov. 29, 2016

(54) CROSSBOW TRIGGER ASSEMBLY

(71) Applicant: Bear Archery, Inc., Evansville, IN (US)

(72) Inventor: Andrew Hughes, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 14/919,802

(22) Filed: Oct. 22, 2015

(65) Prior Publication Data

US 2016/0116243 A1 Apr. 28, 2016

Related U.S. Application Data

(60) Provisional application No. 62/067,679, filed on Oct. 23, 2014.

(51) Int. Cl.

| | |
|---|---|
| ***F41B 5/12*** | (2006.01) |
| ***F41B 5/18*** | (2006.01) |
| ***F41A 19/10*** | (2006.01) |
| ***F41A 19/12*** | (2006.01) |
| ***F41A 17/00*** | (2006.01) |
| ***F41B 5/14*** | (2006.01) |
| ***F41B 7/04*** | (2006.01) |

(52) U.S. Cl.

CPC ..... *F41B 5/12* (2013.01); *F41A 17/00* (2013.01); *F41A 19/10* (2013.01); *F41A 19/12* (2013.01); *F41B 5/123* (2013.01); *F41B 5/1469* (2013.01); *F41B 7/046* (2013.01)

(58) Field of Classification Search

CPC ..... F41B 5/12; F41B 5/1469; F41A 17/00; F41A 19/10; F41A 17/46

USPC ..... 124/25, 31, 35.1, 40

See application file for complete search history.

(56) References Cited

U.S. PATENT DOCUMENTS

| | | | | | |
|---|---|---|---|---|---|
| 5,596,976 | A * | 1/1997 | Waiser | F41B 5/12 | 124/25 |
| 5,598,829 | A * | 2/1997 | Bednar | F41A 17/28 | 124/25 |
| 5,649,520 | A * | 7/1997 | Bednar | F41B 5/12 | 124/25 |
| 5,884,614 | A * | 3/1999 | Darlington | F41B 5/1469 | 124/25 |
| 6,425,386 | B1 * | 7/2002 | Adkins | F41B 5/12 | 124/25 |
| 6,736,123 | B1 * | 5/2004 | Summers | F41A 17/46 | 124/25 |
| 6,802,304 | B1 * | 10/2004 | Chang | F41B 5/1469 | 124/25 |
| 7,174,884 | B2 * | 2/2007 | Kempf | F41B 5/105 | 124/25 |
| 7,588,022 | B2 * | 9/2009 | Chang | F41B 5/123 | 124/25 |
| 7,770,567 | B1 * | 8/2010 | Yehle | F41A 17/46 | 124/25 |

(Continued)

*Primary Examiner* — Alexander Niconovich

(74) *Attorney, Agent, or Firm* — Charles J. Meyer; Woodard, Emhardt et al.

(57) ABSTRACT

Certain embodiments of the present disclosure describe a trigger assembly for use in a crossbow. The trigger assembly includes a floating sear that is able to translate with a cable catch as the cable catch is rotated and also may rotate relative to the cable catch. As the cable catch moves from an uncocked position to a cocked position, the floating sear engages a pivot beam that is engaged with a trigger mechanism.

20 Claims, 12 Drawing Sheets

(56) References Cited

U.S. PATENT DOCUMENTS 8,091,540 B2 * 1/2012 Matasic ..... F41B 5/12 124/25
8,522,761 B1 * 9/2013 Chu ..... F41A 17/46 124/25
8,651,094 B2 * 2/2014 Matasic ..... F41B 5/12 124/23.1
8,770,178 B2 * 7/2014 Kempf ..... F41A 19/10 124/25
8,899,218 B2 * 12/2014 Kempf ..... F41B 5/1469 124/35.1
8,985,091 B2 * 3/2015 Miao ..... F41B 5/1469 124/25
9,255,754 B1 * 2/2016 Kempf ..... F41B 5/12
2009/0078243 A1 * 3/2009 Bednar ..... F41B 5/1469 124/31
2014/0102431 A1 * 4/2014 Kennedy ..... F41B 5/1469 124/35.1
2014/0174419 A1 * 6/2014 McPherson ..... F41A 17/46 124/35.1
2014/0182573 A1 * 7/2014 Miao ..... F41A 19/12 124/35.1

* cited by examiner

CROSSBOW TRIGGER ASSEMBLY

CROSS REFERENCE TO RELATED APPLICATIONS

This application claims the benefit of U.S. Provisional Application No. 62/067,679 filed Oct. 23, 2014, which is hereby incorporated by reference in its entirety.

FIELD OF THE INVENTION

Aspects of the present invention deal with crossbows, and in particular deal with trigger assemblies for use in crossbows.

BACKGROUND OF THE INVENTION

Crossbows have been used for centuries for both hunting and recreation. They are typically characterized by horizontal limbs mounted on a stock with a bowstring that is drawn to store energy that is transferred to a bolt upon firing. The bowstring is held in a string catch that holds the bowstring until the user is ready to fire. When the user is ready to shoot the bolt, the user pulls a trigger. Upon pulling the trigger, a series of interactions occurs between components of a trigger assembly, allowing the bowstring to be released from the string catch and allowing transfer of the energy stored in the bowstring to the bolt.

There are several different designs of crossbows. A recurve crossbow has a bowstring attached directly to limbs that extend from the body of the crossbow. When the bowstring is drawn, the limbs deflect and store potential energy that is transferred to the bowstring and a loaded arrow when the crossbow is fired. A compound crossbow has a set of wheels or cams attached to its limbs. A cabling system attached to the wheels or cams is used to bend the limbs as the bowstring is drawn.

SUMMARY OF THE INVENTION

Certain embodiments deal with a trigger assembly used in a crossbow. The trigger assembly includes a trigger mechanism, a pivot beam, a cable catch, and may include a safety mechanism. The cable catch is designed so that the trigger and pivot beam can remain in a non-firing position and do not need to move while the crossbow is cocked. The design of the trigger assembly may also allow a user to cock the crossbow while the safety mechanism is either engaged or disengaged.

A floating sear is attached to the cable catch and interacts with the pivot beam. In an uncocked position, the floating sear sits above the pivot beam; however, upon cocking the bow, the cable catch rotates and the floating sear slides past the pivot beam. A spring biases the floating sear to rotate downward upon gaining clearance from the pivot beam so that the back surface of the floating sear pivots downward to abut against the front surface of the pivot beam. Contact between the floating sear and the pivot beam maintains the trigger assembly in a loaded position.

To fire the crossbow, a user pulls a trigger, causing the trigger to rotate and moving a trigger roller to contact the pivot beam and to rotate the pivot beam. This rotation causes the front surface of the pivot beam to drop and lose contact with the floating sear. With clearance between the pivot beam and the floating sear, the cable catch is free to rotate and release a bowstring held within the cable catch.

Certain embodiments include a safety mechanism that includes a sliding safety bar with an opening. When the safety mechanism is disengaged, the safety bar is in a position where the opening is aligned with a safety pin mounted between the safety bar and the pivot beam. When the pivot beam rotates upon a user pulling the trigger, the safety pin is able to move into the opening in the safety bar. When the safety mechanism is engaged, the opening in the safety bar is not aligned with the safety pin. In this situation, if a user tries to pull the trigger, the safety pin is blocked and unable to move and thus the pivot beam is prevented from rotating.

DESCRIPTION OF PREFERRED EMBODIMENTS

Figure 1:
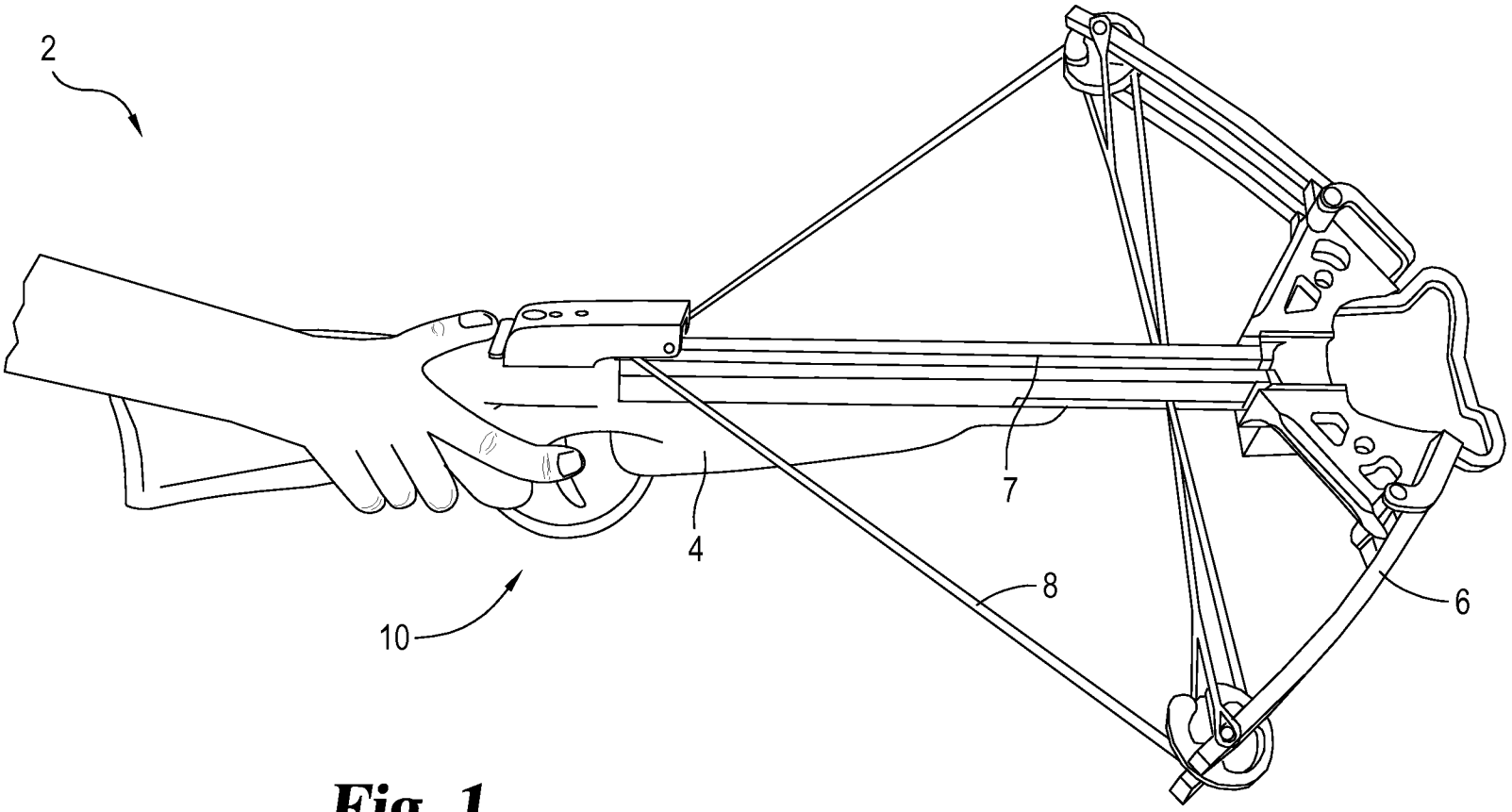
FIG. 1 is a perspective view of a crossbow including an embodiment of a trigger assembly with a user disengaging the safety assembly with the same hand used to pull the trigger.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain embodiments shown in FIGS. 1-13 include a crossbow trigger assembly that includes a floating sear incorporated with a string nut/cable catch that engages with a pivot beam. Pivoting the cable catch to cock the bow with a cable causes the floating sear to pivot and slide past the pivot beam. A spring biases the floating sear to rotate counterclockwise (as illustrated, for reference only) so its back surface pivots downward and abuts the front surface of the pivot beam once there is clearance between the sear and the beam. Contact between the sear and the beam keeps the cable catch in a cocked position against the force of the cable.

In certain embodiments, when cocking the crossbow, the cable contacts a safety bar, pushing the safety bar backward into an engaged position. Thus, the safety mechanism is automatically engaged when a cable is loaded into the cocked position. The safety bar overlies a safety pin and the bar prevents the safety pin from moving, which in turn prevents the pivoting beam from pivoting. To disengage the safety, the user pushes the safety bar slightly forward, for example using the thumb of the hand adjacent the trigger, in the direction of firing. In the disengaged position, a hole in the safety bar is positioned over the safety pin and allows the safety pin to move upward, allowing the pivoting beam to pivot.

When a user pulls the trigger, a roller on the trigger mechanism contacts the pivot beam and urges the beam to rotate clockwise (from the perspective of FIGS. 2-13). This rotation causes the front surface of the pivot beam to drop and lose contact with the floating sear. Once contact with the floating sear is lost, the cable catch is unblocked and free to rotate clockwise to release the cable.

The floating sear setup described above allows the cable catch to pivot during loading without having to move the pivoting beam. This allows the crossbow to be loaded without having to move the trigger or the pivot beam into a firing position.

FIG. 1 illustrates a representative crossbow 2 which generally includes a stock 4. A pair of limbs 6 extends from respective sides of stock 4, and a rail 7 sits on top of stock 4. A bowstring cable 8 extends between limbs 6 and is shown in FIG. 1 in the drawn or cocked position. A trigger assembly 10 is arranged with stock 4. Trigger assembly 10 extends above and from the underside of stock 4 and is used to release bowstring 8 from the drawn position, firing a bolt when a bolt is loaded onto rail 7. Trigger assembly 10 is useful with various variations of crossbows, including recurve and compound bows, and may be used in conjunction with other accessories attached to the crossbow.

Figure 2:
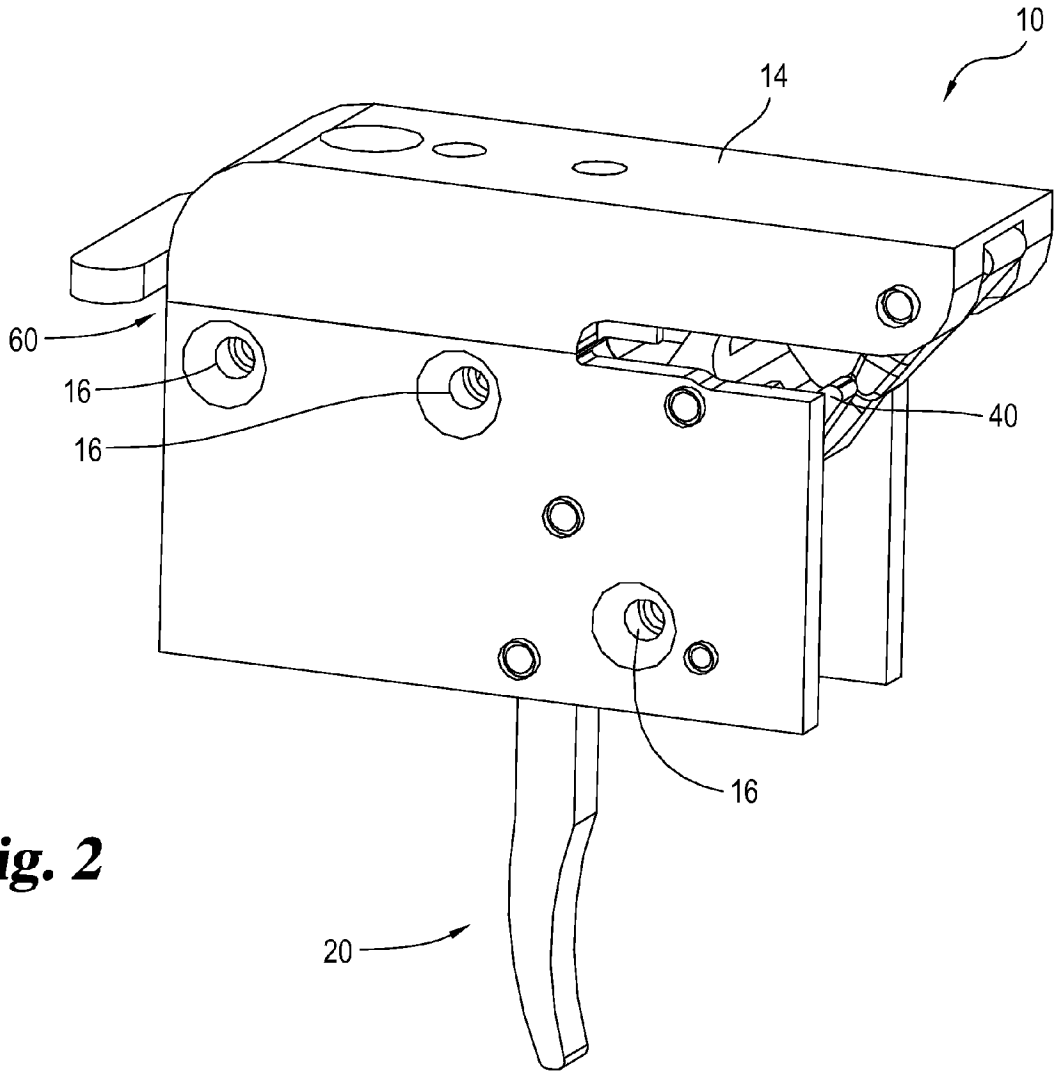
FIG. 2 is a perspective exterior view of an embodiment of a trigger assembly.

FIG. 2 illustrates an example of a crossbow trigger assembly generally designated as 10. For reference, the term forward is used to describe the direction in which an arrow/bolt is fired and the term rearward is defined to be the opposite direction. A housing 14 encloses the components of crossbow trigger assembly 10. In the embodiment shown housing 14 includes a middle block portion, a top portion, and two side portions. Other embodiments may be monolithic, or include more or fewer portions. These components include a trigger mechanism 20, a cable catch 40, and a safety mechanism 60. Crossbow trigger assembly 10 is generally attached to the stock of a crossbow. In use, cable catch 40 retains a drawn bowstring, and a user pulls on trigger mechanism 20 to release the bowstring from cable catch 40, firing a loaded bolt from the crossbow. Attachment holes 16 provide points at which trigger assembly 10 is secured to the crossbow stock. For example, trigger assembly 10 may be mounted within the crossbow stock. In the embodiment shown, there are three visible attachment holes 16; however, other embodiments may have more or fewer holes or other methods of attachment.

Figure 3:
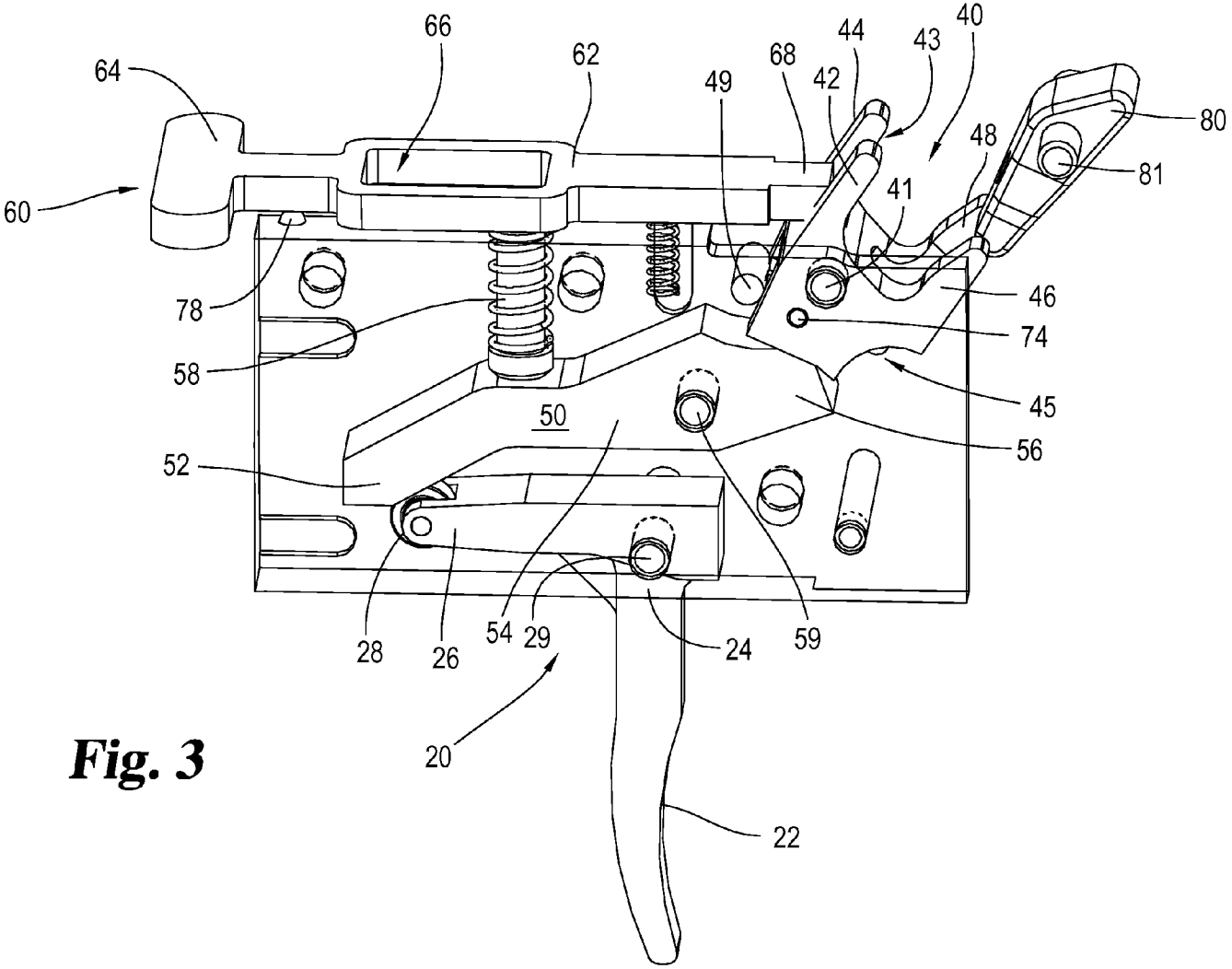
FIG. 3 is a perspective interior view of the trigger assembly of FIG. 2 in an uncocked position.
Figure 4:
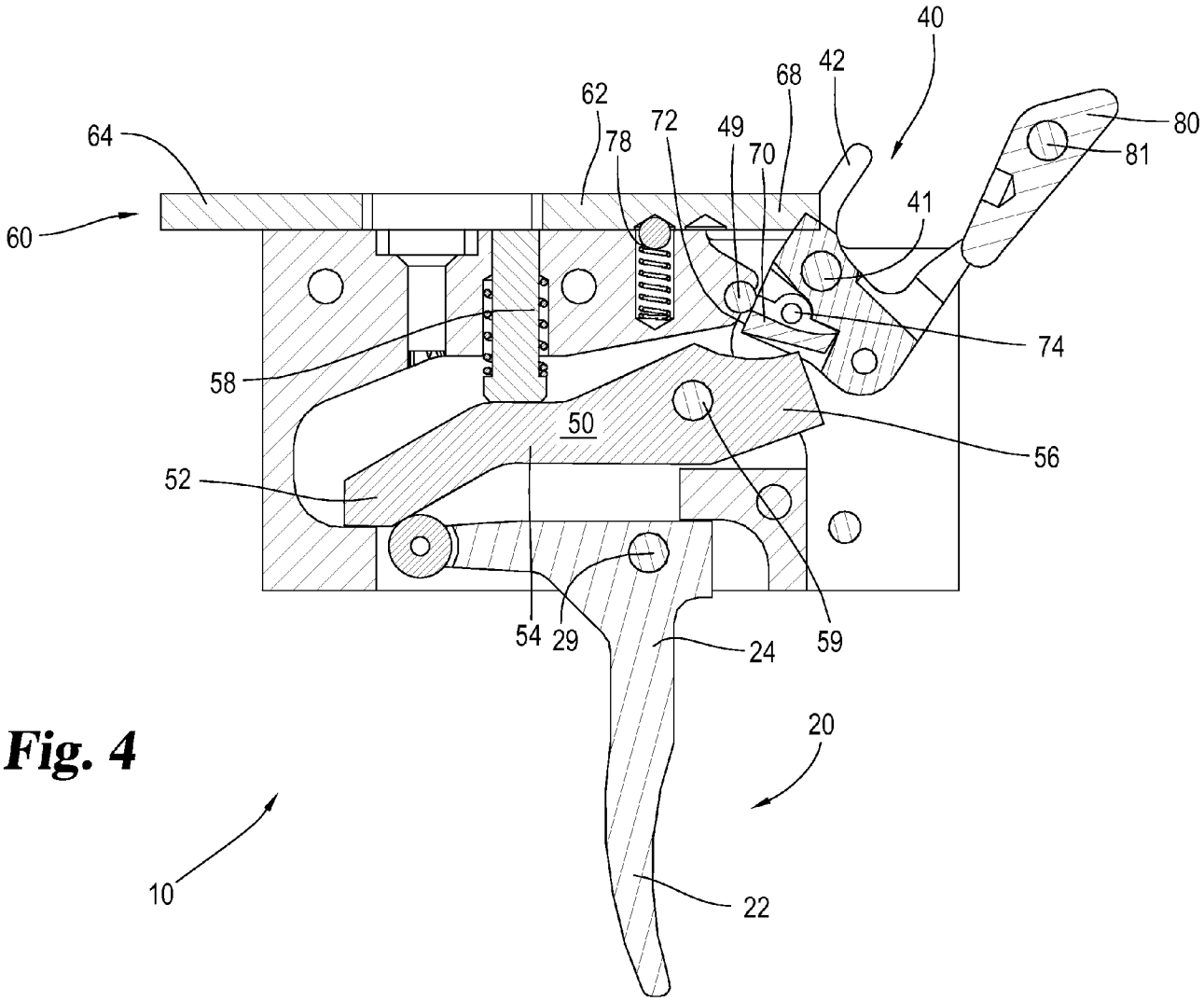
FIG. 4 is a side cross-sectional view of the trigger assembly of FIG. 3.

FIGS. 3-4 show an example of trigger assembly 10 in an uncocked position. In FIGS. 3-12, some portions of housing 14 have been removed to show the inner components contained within trigger assembly 10. Trigger mechanism 20 is rotatably coupled to housing 14 and includes a trigger 22 that extends from housing 14 to be pulled by a user. A top portion 24 of trigger 22 is connected to a trigger bar 26 that extends rearward. A beam contact member 28 is attached at the rearward end of trigger bar 26. In the embodiment shown, beam contact member 28 is a wheel that rotates as it moves along pivot beam 50, but contact member 28 may be any component that contacts beam pivot beam 50 and can urge beam 50 to pivot. In other embodiments, trigger bar 26 may directly contact pivot beam 50. Trigger mechanism 20 is rotatably attached to housing 14 at pivot 29.

A sear or pivot beam 50 is positioned directly above trigger mechanism 20 and includes a rearward portion 52, a medial portion 54, and a forward portion 56. Contact member 28 generally contacts the bottom surface of rearward portion 52. The bottom surface of rearward portion 52 angles upward, providing a surface on which contact member 28 may roll when trigger mechanism 20 and pivot beam 50 both rotate. Medial portion 54 of pivot beam 50 forms a level surface adjacent a safety pin 58. Pivot beam 50 may pivot or rotate with respect to housing 14 on an attachment point to housing 14 at pivot 59.

Cable catch 40 is rotatably attached to housing 14 at a pivot point 41 and biased to rotate clockwise, in a forward direction. Cable catch 40 is shaped so that its top portion is able to retain the bowstring cable of a crossbow. The upper portion of cable catch 40 has two sets of prongs, rearward prongs 42, 44 and forward prongs 46, 48. A slot-like top opening 43 provides spacing between prong 42 and prong 44 and also provides spacing between prong 46 and prong 48. In the embodiment shown, the prongs are positioned so the upper portion of cable catch 40 has a substantially U-shaped channel between rearward prongs 42, 44 and forward prongs 46, 48 from a side view.

The bottom portion of cable catch 40 forms a slot-like bottom opening 45 between two side pieces. A floating sear 70 is rotatably mounted in opening 45 between the side pieces at sear pivot 74. Floating sear 70 translates with cable catch 40 as cable catch 40 rotates around pivot point 41. Sear pivot 74 allows floating sear 70 to also rotate with respect to cable catch 40. A stop 49 within housing 14 limits the clockwise rotation of cable catch 40 and floating sear 70.

FIG. 4 illustrates a cross-sectional, internal view of trigger assembly 10 in an uncocked position to make it easier to see the position and operation of floating sear 70. As seen, the rearward surface 72 of floating sear 70 abuts stop 49, and the bottom surface of floating sear 70 rests on or above forward portion 56 of pivot beam 50. In this position, cable catch 40 is positioned to receive a bowstring.

Safety mechanism 60 includes a safety bar 62 that slides horizontally within trigger assembly 10. A safety switch 64 is positioned at the rearward end of safety bar 62. Visible in FIG. 3, the medial portion of safety bar 62 has an opening 66 that interacts with safety pin 58. A forward portion 68 of safety bar 62 narrows so safety bar 62 can slide between top opening 43 between first prong 42 and second prong 44 of cable catch 40. Movement of safety mechanism 60 is separate from other features of trigger assembly 10 such as trigger mechanism 20, cable catch 40, or pivot beam 50. Therefore, safety mechanism 60 may slide horizontally between an engaged position and a disengaged position without requiring movement of trigger mechanism 20, cable catch 40, or pivot beam 50.

A detent 78 is positioned underneath safety bar 62. Detent 78, for example, may be a spring-loaded, protruding ball bearing. Detent 78 engages with notches on the underside of safety bar 62. These notches are positioned at the forward and rearward limits of the movement of safety bar 62 with respect to detent 78. Detent 78 may be positioned to engage a corresponding notch to urge safety mechanism 60 to remain in either in an engaged or disengaged position.

For some embodiments, when trigger assembly 10 is in an uncocked position, as shown in FIGS. 3-4, safety mechanism 60 is in a disengaged position. When safety mechanism 60 is disengaged, opening 66 is located above safety pin 58 allowing clearance for safety pin 58 to move upward into opening 66. It is also possible for the safety to be engaged while trigger assembly 10 is in its uncocked position.

Trigger assembly 10 also includes an anti-dry fire lever 80 positioned so that when a bolt is not loaded in the crossbow, an end of lever 80 is in the forward end of opening 43. Lever 80 is attached to housing 14 at pivot 81, so that it may rotate with respect to housing 14. The anti-dry fire lever is engaged when lever 80 is positioned as shown in FIG. 3. In this position, lever 80 is able to block the passage of a drawn bowstring that is released by cable catch 40 (see FIG. 9), preventing damage that might occur to a crossbow if it is fired without having a loaded bolt. Anti-dry fire lever 80 is disengaged by loading a bolt between prongs 42, 44. Inserting the bolt causes lever 80 to rotate around pivot 81 providing clearance for the bowstring and bolt to pass when the crossbow is fired.

Figure 5:
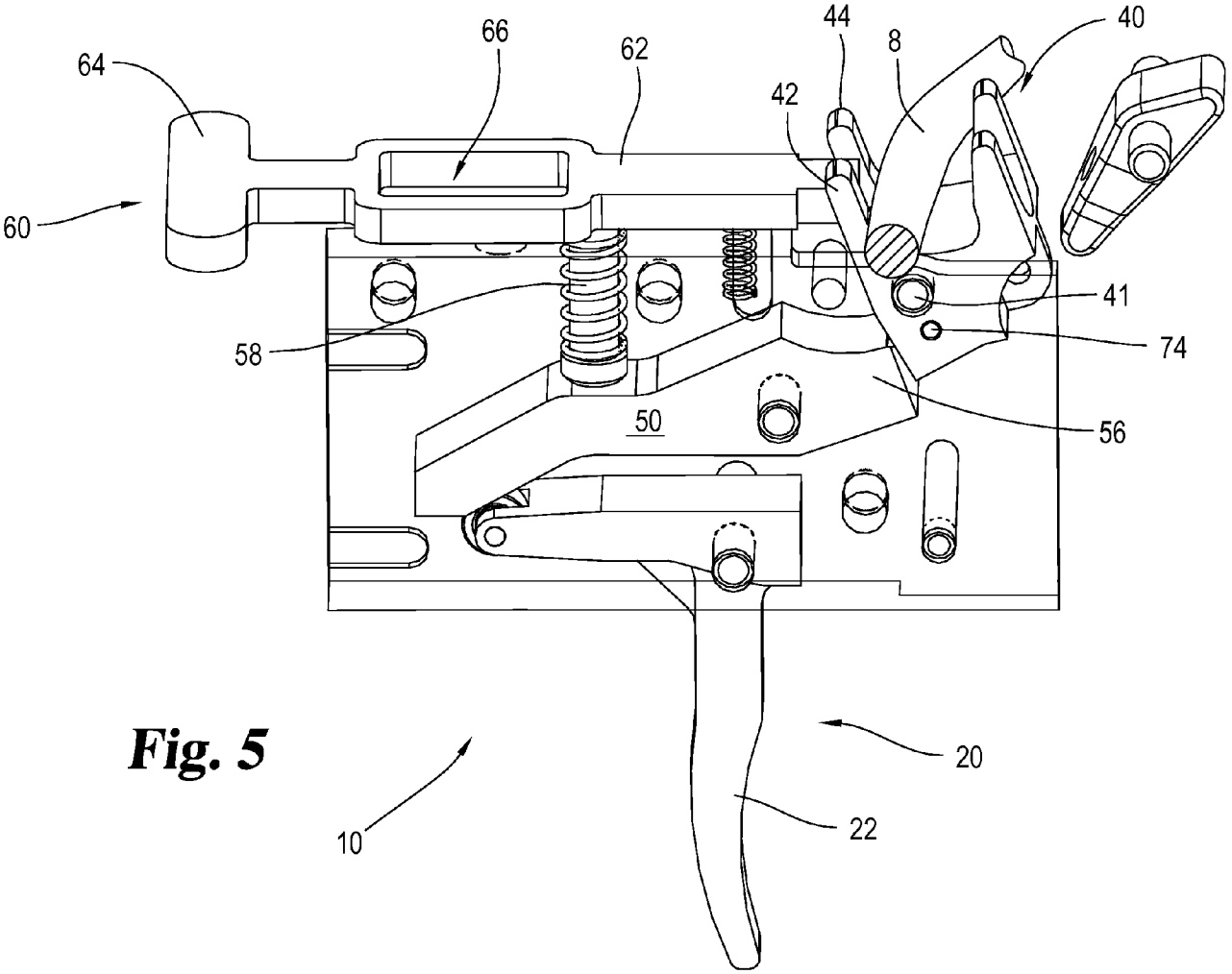
FIG. 5 is a perspective internal view of the trigger assembly of FIG. 2 in a cocking position.
Figure 6:
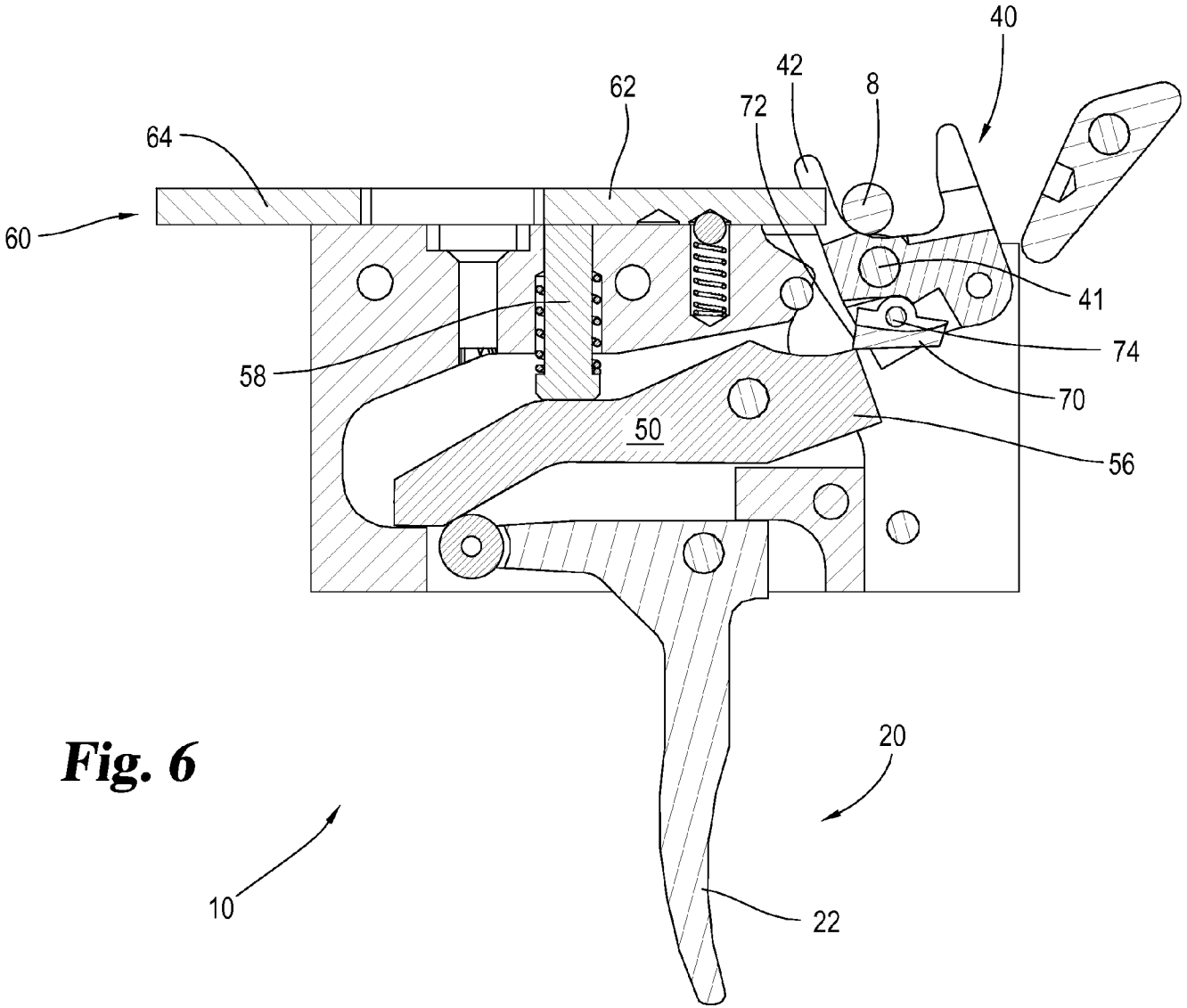
FIG. 6 is a side cross-sectional view of the trigger assembly of FIG. 5.

FIGS. 5-6 show trigger assembly 10 as it is being cocked. To reach this position, a user pulls a bowstring 8 rearward into cable catch 40. Bowstring 8 is pulled past prongs 46, 48 so it enters the U-shaped recess in cable catch 40. The user continues to pull bowstring 8 so it contacts prongs 42, 44. The pulling force applied by the user on bowstring 8 is applied to prongs 42, 44 and causes cable catch 40 to rotate counter-clockwise around pivot 41. As cable catch 40 rotates, floating sear 70 begins to slide and translate forward over the top surface of forward portion 56 of pivot beam 50. At the position shown in FIG. 6, the rearward edge 72 of floating sear 70 is just about to clear forward portion 56 of pivot beam 50.

Also, as cable catch 40 rotates, bowstring 8 contacts forward portion 68 of safety bar 62 between prongs 42, 44, forcing safety bar 62 to slide rearward and automatically engaging safety mechanism 60. As safety bar 62 slides rearward, safety opening 66 slides past safety pin 58, so that opening 66 and pin 58 are no longer aligned. In this position, safety mechanism 60 is engaged, as the lack of clearance between opening 66 and pin 58 will not allow pivot beam 50 to rotate if trigger 22 is pulled.

In other embodiments, the crossbow may be cocked while the safety is already set in the engaged position. For example, safety bar 62 can be manually slid rearward until opening 66 is no longer positioned above safety pin 58. The rotation of cable catch 40 while it is being cocked does not affect the position of pivot beam 50, so safety pin 58 does not move during the cocking process. This provides the advantage of allowing the user to cock the crossbow while safety mechanism 60 is engaged.

Figure 7:
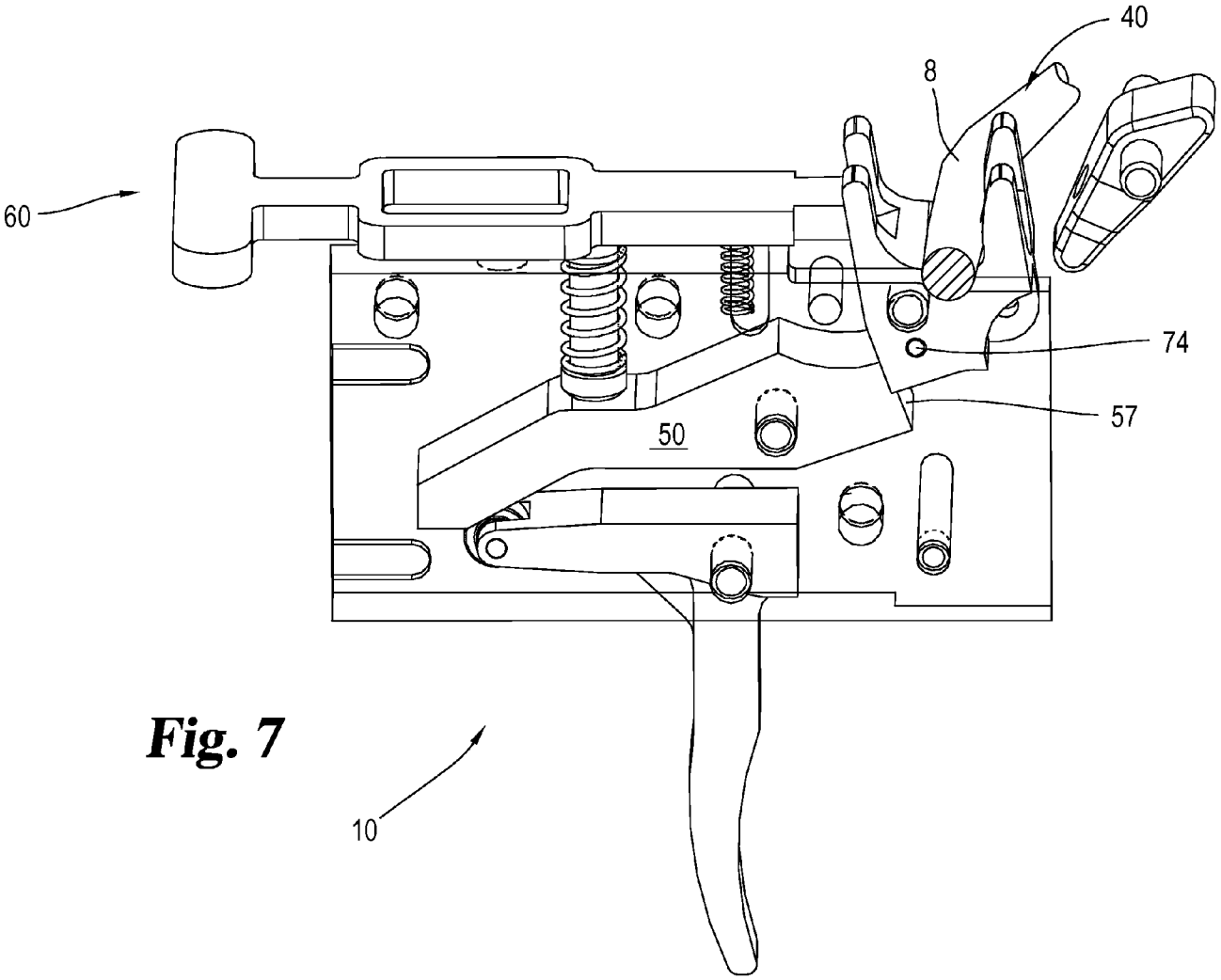
FIG. 7 is a perspective interior view of the trigger assembly of FIG. 2 in a cocked position with the safety engaged.
Figure 8:
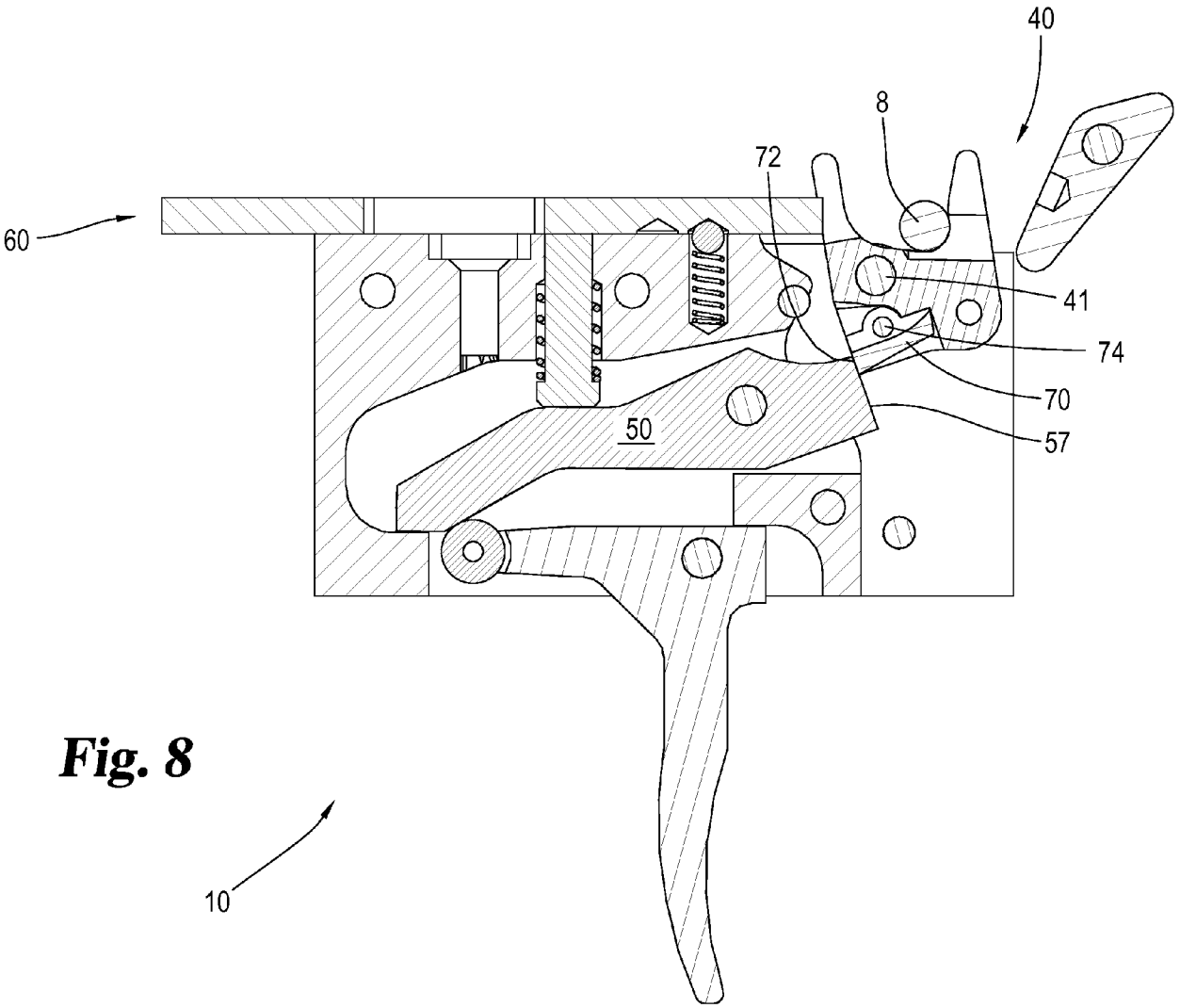
FIG. 8 is a side cross-sectional view of the trigger assembly of FIG. 7.

FIGS. 7-8 show trigger assembly 10 in a cocked position with safety mechanism 60 engaged. Once bowstring cable 8 causes sufficient rotation of cable catch 40 to cause floating sear 70 to clear forward portion 56 of pivot beam 50, floating sear 70 may rotate around pivot 74 so that it drops to a position forward of pivot beam 50. In some embodiments, floating sear 70 is biased so it rotates counter-clockwise (i.e. rear end downward upon clearance and into the position shown in FIG. 8). In this position, the rearward surface 72 of floating sear 70 rests against a forward surface 57 of pivoting beam 50, holding cable catch 40 in the cocked position and preventing cable catch 40 from rotating clockwise around pivot 41 due to the tension of the drawn bowstring cable 8.

Due to the ability of floating sear 70 to rotate, pivot beam 50 is able to remain stationary throughout the cocking process. Because pivot beam 50 does not rotate as cable catch 40 is moved into the cocked position, trigger mechanism 20 also remains stationary throughout the cocking process. This feature allows trigger mechanism 20 and pivot beam 50 to remain in a non-firing position while the cable 8 is loaded into cable catch 40.

Figure 9:
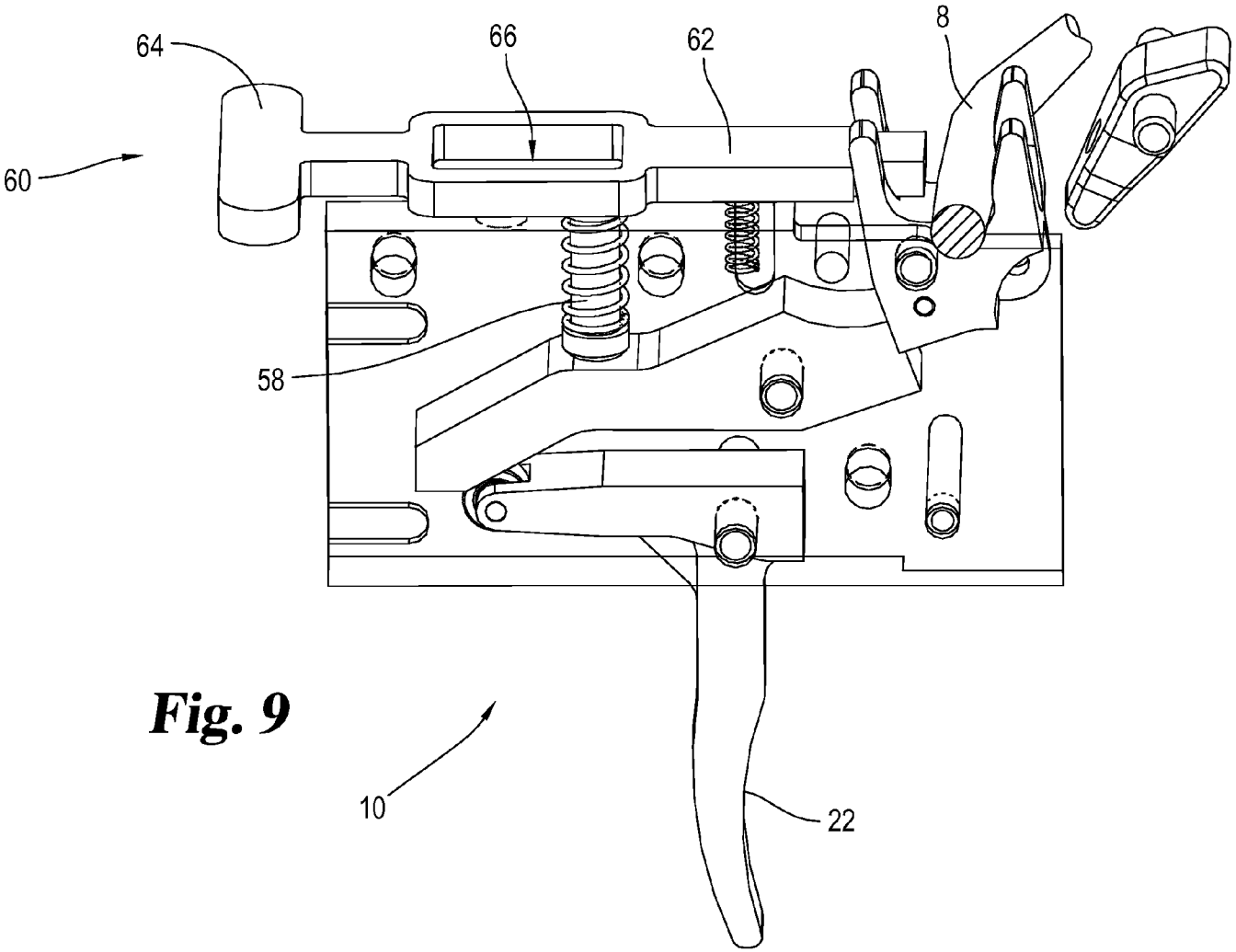
FIG. 9 is a perspective internal view of the trigger assembly of FIG. 2 in a cocked position with the safety disengaged.
Figure 10:
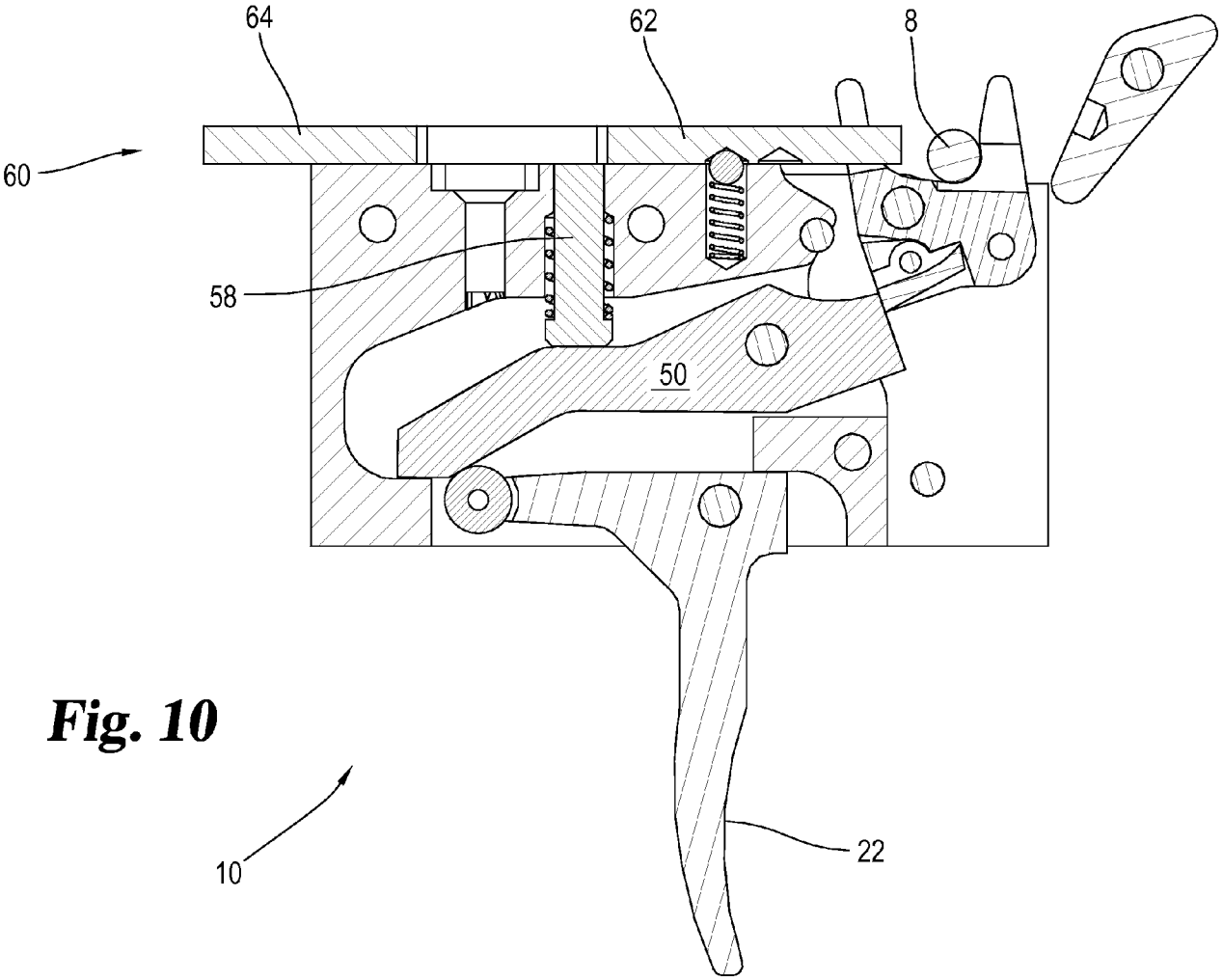
FIG. 10 is a side cross-sectional view of the trigger assembly of FIG. 9.

FIGS. 9-10 show trigger assembly 10 in a cocked position with safety mechanism 60 disengaged. To disengage safety mechanism 60, a user pushes safety switch 64 slightly forward, causing safety bar 62 to slide forward. In the illustrated embodiment, safety switch 64 is positioned so a user may have a finger on or adjacent trigger 22 and operate safety mechanism 60 with the same hand by pushing safety switch 64 with their thumb (see FIG. 1). The user's hand does not need to be moved from the firing position. When safety switch 64 is pushed, safety bar 62 slides forward until opening 66 is positioned over the top of safety pin 58, providing clearance for pin 58 to move upward into opening 66.

Figure 11:
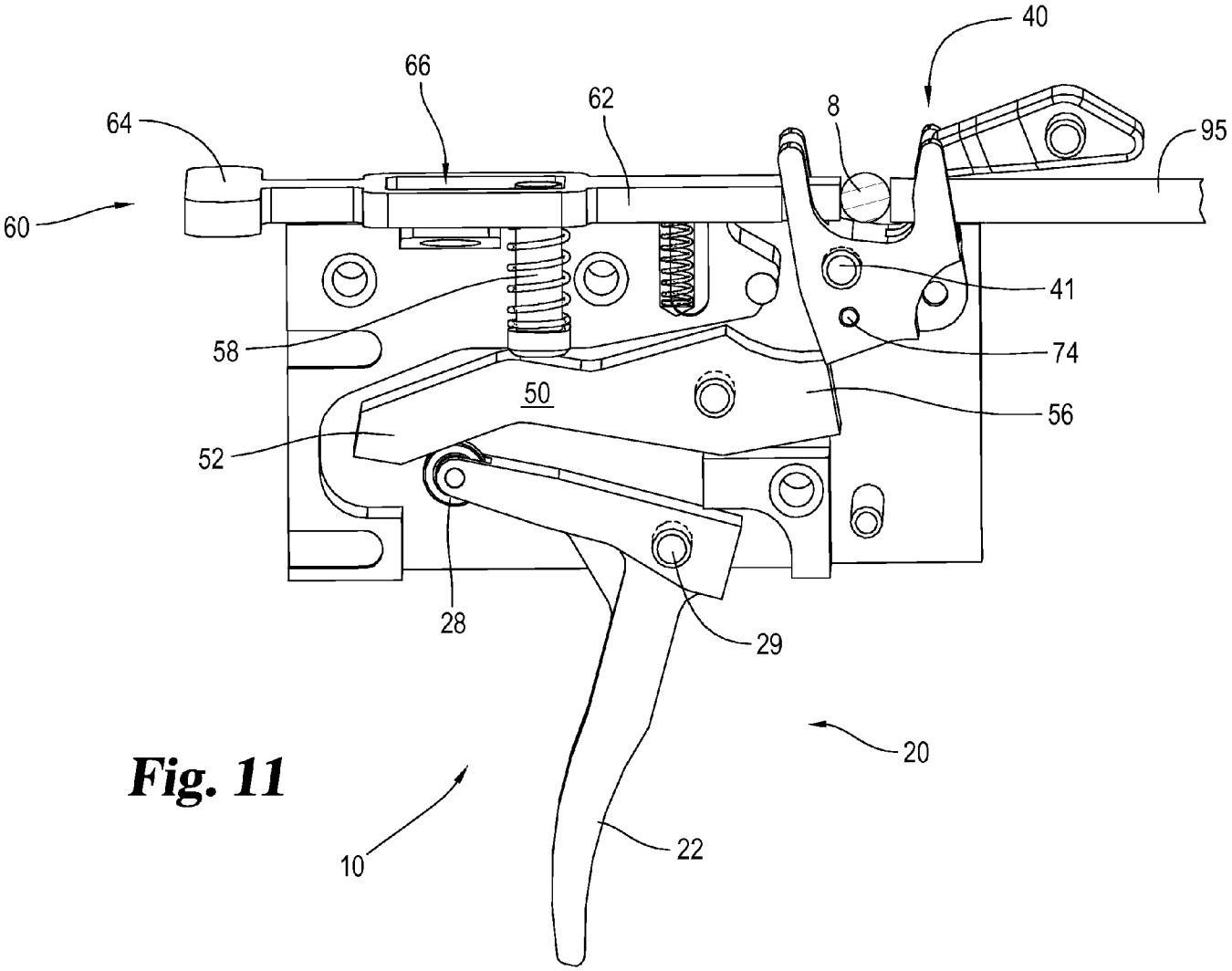
FIG. 11 is a cross-sectional view of the trigger assembly of FIG. 2 in a position after the trigger has been pulled.
Figure 12:
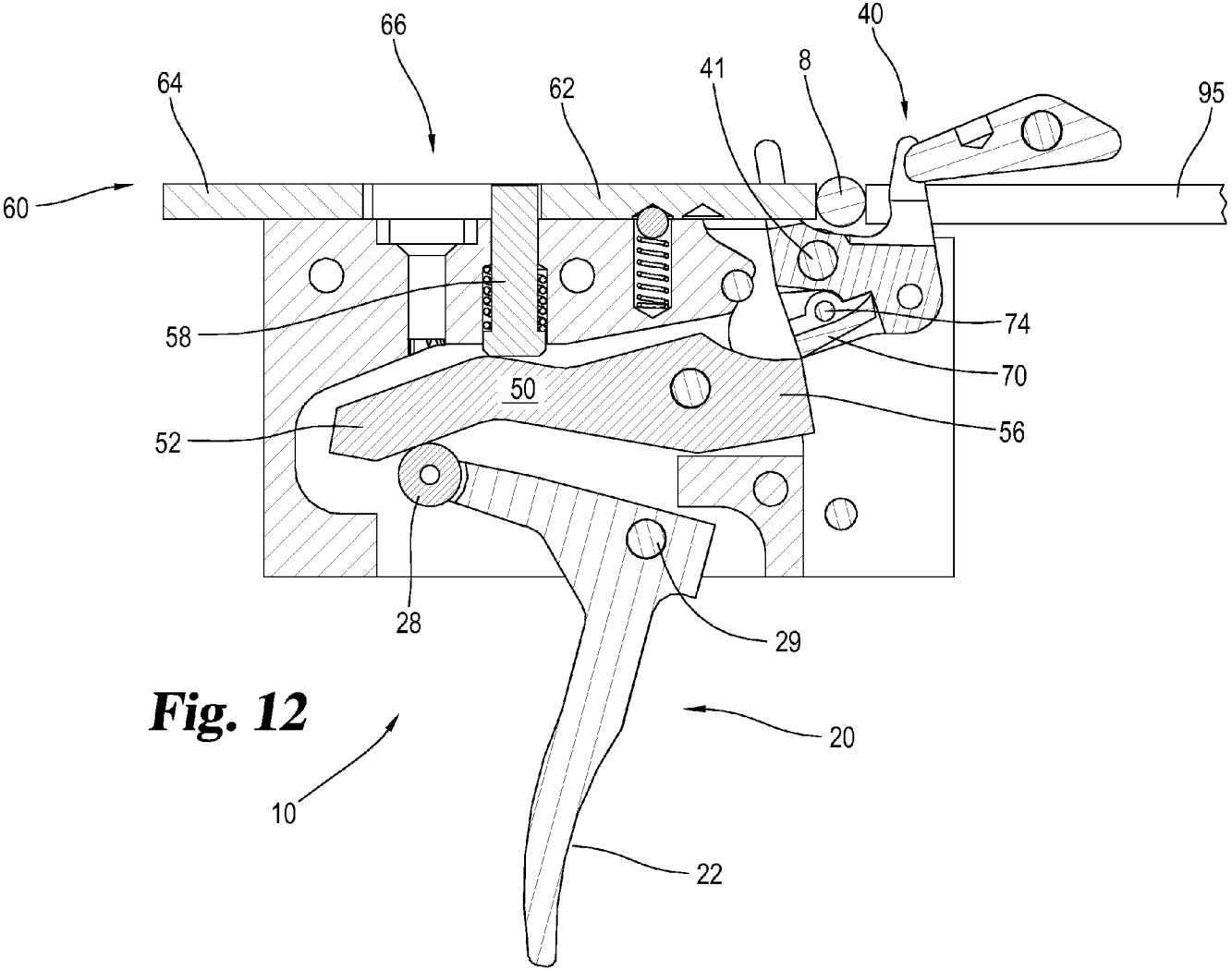
FIG. 12 is a side cross-sectional view of the trigger assembly of FIG. 11.

FIGS. 11-12 show trigger assembly 10 after a bolt 95 has been loaded and as trigger 22 is being pulled. A user pulls trigger 22 rearward causing trigger mechanism 20 to pivot clockwise around pivot 29. As trigger mechanism 20 pivots, contact member 28 engages the angled surface of rearward portion 52 of pivot beam 50. The force from contact member 28 urges pivot beam 50 to rotate clockwise.

The clockwise rotation of pivot beam 50 forces safety pin 58 to move upward. As long as safety mechanism 60 is in the disengaged position, the movement of safety pin 58 is unconstrained and pin 58 enters opening 66. The forward portion 56 of pivot beam 50 moves downward as pivot beam 50 rotates, eventually providing clearance between forward portion 56 and floating sear 70. Once there is clearance and floating sear 70 disengages from forward portion 56, cable catch 40 rotates clockwise. The clockwise rotation of cable catch 40 releases bowstring 8 and, in turn, fires bolt 95.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A trigger assembly attached to a crossbow with a bowstring cable, wherein said trigger assembly comprises:

a housing attached to a stock of the crossbow;

a trigger mechanism including a trigger, wherein said trigger mechanism is rotatably coupled to said housing;

a pivot beam rotatably coupled to said housing, wherein said pivot beam is operatively engaged with said trigger mechanism so that rotation of said trigger mechanism by pulling said trigger urges said pivot beam to rotate;

a cable catch rotatably coupled to said housing at a pivot point, wherein said cable catch is able to retain the bowstring cable of the crossbow, and wherein said cable catch is adapted to rotate about said pivot point between an uncocked position and a cocked position;

a floating sear rotatably coupled to said cable catch at a sear pivot wherein said floating sear is adapted to translate with the rotation of said cable catch around said pivot point and wherein said floating sear is also adapted to rotate relative to said cable catch around said sear pivot;

wherein when said cable catch is rotated from said uncocked position to said cocked position, said floating sear translates over said pivot beam and rotates so that said floating sear drops to a position forward of and abutting said pivot beam, thereafter holding said cable catch in said cocked position; and, wherein said pivot beam remains stationary when said cable catch is rotated between said uncocked position and said cocked position.

2. The crossbow trigger assembly of claim 1, wherein said trigger mechanism remains stationary when said cable catch is rotated between said uncocked position and said cocked position.

3. The crossbow trigger assembly of claim 1, comprising:

a safety mechanism, wherein said safety mechanism is movable between an engaged position and a disengaged position; and, wherein said cable catch may be rotated from said uncocked position to said cocked position while said safety mechanism is in said engaged position.

4. The crossbow trigger assembly of claim 3, comprising a detent, wherein said detent engages said safety mechanism to hold said safety mechanism in said engaged position or to hold said safety mechanism in said disengaged position.

5. The crossbow trigger assembly of claim 1, wherein rotation of said cable catch into said cocked position when said bowstring cable is received in said cable catch causes a safety mechanism to move into an engaged position.

6. The crossbow trigger assembly of claim 1, wherein said trigger mechanism includes a wheel that contacts said pivot beam, and wherein said wheel is adapted to roll along a surface of said pivot beam when said trigger mechanism rotates.

7. A trigger assembly attached to a crossbow with a bowstring cable, wherein said trigger assembly comprises:

a housing attached to a stock of the crossbow;

a trigger mechanism rotatably coupled to said housing;

a pivot beam including a forward planar surface, wherein said pivot beam is rotatably coupled to said housing, and wherein said trigger mechanism operatively engages said pivot beam so that rotation of said trigger mechanism by pulling said trigger urges said pivot beam to rotate;

a cable catch rotatably coupled to said housing at a pivot point, wherein said cable catch is adapted to rotate about said pivot point between an uncocked position and a cocked position;

a floating sear including a rearward planar surface, wherein said floating sear is rotatably coupled to said cable catch at a sear pivot;

wherein said floating sear is adapted to translate with the rotation of said cable catch around said pivot point and wherein said floating sear is also adapted to rotate relative to said cable catch around said sear pivot;

wherein said floating sear is arranged to slide relative to said pivot beam when said cable catch is being moved to the cocked position, and, wherein when said cable catch is in said cocked position, said rearward planar surface of said floating sear is parallel to and abuts said forward planar surface of said pivot beam and holds said cable catch in said cocked position.

8. The crossbow trigger assembly of claim 7, comprising:

a safety mechanism, wherein said safety mechanism is movable between an engaged position and a disengaged position wherein rotation of said cable catch into said cocked position when said bowstring cable is received in said cable catch causes said safety mechanism to move into said engaged position.

9. The crossbow trigger assembly of claim 7, wherein rotation of said trigger mechanism while said cable catch is held in said cocked position urges said pivot beam to disengage from said floating sear.

10. The crossbow trigger assembly of claim 7, wherein said floating sear is biased relative to said cable catch so that upon gaining clearance from the pivot beam when said cable catch is being moved to the cocked position said floating sear rotates so that said rearward planar surface of said floating sear is parallel to said forward planar surface of said pivot beam.

11. The crossbow trigger assembly of claim 7, wherein said cable catch defines a stop which limits rotation of said floating sear relative to said cable catch.

12. A trigger assembly attached to a crossbow with a bowstring cable, wherein said trigger assembly comprises:

a housing attached to a stock of the crossbow;

a trigger mechanism including a trigger, wherein said trigger mechanism is rotatably coupled to said housing;

a pivot beam rotatably coupled to said housing, wherein said pivot beam is operatively engaged with said trigger mechanism so that rotation of said trigger mechanism by pulling said trigger urges said pivot beam to rotate;

a cable catch rotatably coupled to said housing at a pivot point, and wherein said cable catch is adapted to rotate about said pivot point between an uncocked position and a cocked position;

a floating sear rotatably coupled to said cable catch at a sear pivot wherein said floating sear is adapted to translate with the rotation of said cable catch around said pivot point, wherein said floating sear is also adapted to rotate relative to said cable catch around said sear pivot, and wherein said cable catch defines a stop which limits rotation of said floating sear relative to said cable catch;

a safety mechanism, wherein said safety mechanism is movable between an engaged position and a disengaged position; and, wherein said cable catch may be rotated from said uncocked position to said cocked position while said safety mechanism is in said engaged position.

13. The crossbow trigger assembly of claim 12, wherein said safety mechanism is positioned so that a user may move said safety mechanism between said engaged position and said disengaged position with one hand while keeping the hand adjacent the trigger.

14. The crossbow trigger assembly of claim 12, wherein rotation of said cable catch into said cocked position when said bowstring cable is received in said cable catch causes said safety mechanism to move into said engaged position.

15. The crossbow trigger assembly of claim 12, wherein said safety mechanism includes a safety bar defining an unobstructed opening.

16. The crossbow trigger assembly of claim 15, comprising a detent, wherein said detent engages said safety bar to urge said safety mechanism to remain in said engaged position or to urge said safety mechanism to remain in said disengaged position.

17. The crossbow trigger assembly of claim 15, further comprising a safety pin defining a longitudinal axis, wherein said safety pin abuts said pivot beam so that said safety pin translates along its longitudinal axis with rotation of said pivot beam.

18. The crossbow trigger assembly of claim 17, wherein when said safety mechanism is in said engaged position, said safety bar blocks movement of said safety pin so that said pivot beam is prohibited from rotating.

19. The crossbow trigger assembly of claim 17, wherein when said safety mechanism is in said disengaged position, said safety pin is aligned along its longitudinal axis with said opening in said safety bar and said safety pin may translate into said opening upon rotation of said pivot beam.

20. The crossbow trigger assembly of claim 12, wherein said pivot beam remains stationary when said safety mechanism is moved between said engaged position and disengaged position.

* * * * *